US006050411A

United States Patent [19]

Gabrio et al.

[11] Patent Number: 6,050,411

[45] **Date of Patent: *Apr. 18, 2000**

[54] COIL CAP

[76] Inventors: William G. Gabrio, 410 E. Trent, Spokane; Andrew N Barrett; Craig G. Dolsby, both of E. 410 Trent, Spokane, all of Wash. 99202

[ * ] Notice: This patent is subject to a terminal disclaimer.

[21] Appl. No.: 09/140,823

[22] Filed: Aug. 26, 1998

Related U.S. Application Data

[63] Continuation-in-part of application No. 08/950,149, Oct. 14, 1997, Pat. No. 5,819,938.

[51] Int. Cl.[7] ..... B65D 85/66

[52] U.S. Cl. ..... 206/414; 206/413

[58] Field of Search ..... 206/389, 401, 206/398, 413, 414, 415, 416; 428/906; 215/227, 323, 348

[56] References Cited

U.S. PATENT DOCUMENTS

| | | | |
|---|---|---|---|
| D. 347,567 | 6/1994 | Duffy | D8/354 |
| 1,491,063 | 4/1924 | Piper . | |
| 1,603,959 | 10/1926 | Leven . | |
| 1,633,276 | 6/1927 | Russell | 215/323 |
| 1,645,158 | 10/1927 | Russell | 215/323 |
| 1,989,182 | 1/1935 | Blake . | |
| 2,883,045 | 4/1959 | Abramson | 206/59 |
| 3,590,991 | 7/1971 | Sloan | 206/59 C |
| 3,633,335 | 1/1972 | Johnson | 53/380 |
| 3,669,255 | 6/1972 | Raymus | 206/59 F |
| 3,670,877 | 6/1972 | Reed | 206/59 F |
| 3,726,396 | 4/1973 | Birkner | 206/52 R |
| 3,857,486 | 12/1974 | Klebanoff | 206/386 |
| 3,878,940 | 4/1975 | Wiltbort | 206/416 |
| 3,895,711 | 7/1975 | Hiltunen | 206/413 |
| 3,921,863 | 11/1975 | Reed | 206/389 |
| 3,942,638 | 3/1976 | Stone | 206/416 |
| 3,971,489 | 7/1976 | Welch et al. | 215/348 |
| 4,185,742 | 1/1980 | Fisk et al. | 206/414 |
| 4,265,954 | 5/1981 | Romanek | 428/85 |
| 4,299,921 | 11/1981 | Youssef | 215/348 |
| 4,470,508 | 9/1984 | Yen | 206/460 |
| 4,505,387 | 3/1985 | Seto | 206/414 |
| 4,516,892 | 5/1985 | Curro | 410/155 |
| 4,677,728 | 7/1987 | Straus | 206/414 |
| 4,793,485 | 12/1988 | Bertolotti | 206/397 |
| 4,820,374 | 4/1989 | Lamb | 156/538 |
| 4,911,299 | 3/1990 | Peeters | 206/410 |
| 4,995,512 | 2/1991 | Liebel | 206/396 |
| 5,090,566 | 2/1992 | Yount | 206/416 |
| 5,133,171 | 7/1992 | Chase | 53/409 |
| 5,167,322 | 12/1992 | Lemaire | 206/410 |
| 5,337,895 | 8/1994 | Mitelman et al. | 206/416 |
| 5,366,085 | 11/1994 | Kewin | 206/407 |
| 5,572,848 | 11/1996 | Wall | 53/136.2 |
| 5,660,277 | 8/1997 | Bostic | 206/397 |
| 5,819,938 | 10/1998 | Gabrio et al. | 206/414 |

*Primary Examiner*—David T. Fidei
*Attorney, Agent, or Firm*—David S. Thompson

[57] ABSTRACT

A coil cap cover for a cylindrical coil of aluminum stock provides round portion 20 sized to fit either end of the cylindrical coil of aluminum and a substantially rectangular attached skirt portion 60 which covers an adjacent portion of the cylindrical sidewall of the coil. A welded region 70 connects a perimeter edge of the round fabric portion to an upper edge of the fabric skirt portion, creating a three-dimensional coil cap. An overlap weld 80 fastens the upper edges of the ends of the skirt portion together with a segment of the perimeter of the round fabric portion. A crimp weld 90 fastens a lower corner of each end of the skirt portion together.

8 Claims, 3 Drawing Sheets

COIL CAP

CROSS-REFERENCES

This application is a continuation in part of application Ser. No. 08/950,149, filed Oct. 14, 1997, now U.S. Pat. No. 5,819,938.

BACKGROUND

Aluminum stock produced by aluminum manufacturers is often sold in cylindrical coils, typically having a diameter of 10" to 90". As a protective measure, the circular ends of such cylindrical coils are typically covered by a fabric coil cap. Coil caps typically provide a circular end piece having a perimeter attached to a rectangular skirt piece which wraps about an end portion of the cylindrical sidewalls of the aluminum coil. In providing such a coil cap, it is important to maximize the protective nature, particularly on the circular end surface, while also minimizing the overall cost.

Known coil caps are typically constructed of a fabric skirt portion that is made of a woven polyethylene fabric which is coated with polyethylene. In most applications, the round fabric is made of a single or double layer of a spun-bonded olefin fabric. In the construction of such known coil caps, the round fabric is then glued to the coated polyethylene skirt. Where double layers of round fabric are used, it is frequently the case that hot glue is applied to both sides of an upper edge of the skirt, which is then sandwiched between the two round layers. Glue is used because welding two such dissimilar fabrics together is not possible.

Coil caps constructed according to the above method are not easily recyclable. This is primarily because of the very dissimilar nature of the polyethylene skirt and the spun-bounded olefin round fabric. Additionally, the glue used to bond these dissimilar fabrics together also tends to prevent convenient recycling.

What is needed is a coil cap having a lighter-weight skirt, which can be more economically produced, combined with a heavier-weight round portion, which can better protect the cylindrical aluminum coil. The round portion and skirt portion should be made of the same material to promote recyclability. The means of connection between the two portions should not require glue, which is an expense in the manufacturing process, results in a weaker product and which prevents convenient recyclability.

SUMMARY

The present invention is directed to a coil cap that satisfies the above needs. A preferred embodiment of the coil cap of the present invention provides:

(A) A heavier-weight round portion is made of extruded polyethylene, woven and coated polyethylene, or other plastic material. In a typical embodiment, the round portion is made of extruded polyethylene, typically having a thickness of 0.003" to 0.5", and in a preferred embodiment a thickness of 0.1875". Similarly, the diameter of a typical extruded round portion is 4" to 150", but in many applications is 60".

(B) A lighter-weight rectangular skirt portion is made of woven, coated polyethylene fabric or extruded plastic sheet. In a preferred embodiment, the skirt portion is made of woven fabric 6 mils thick, having a coating of polyethylene of approximately 1 mil thick on each side.

(C) A welded region, joining the perimeter edge of the heavier-weight extruded round portion to the upper edge of the lighter-weight skirt fabric portion.

(D) In many applications, a crimp weld secures together a lower corner on each end of the rectangular fabric skirt portion.

In some versions of the coil cap, an added layer of material is attached to the lower surface of the heavier-weight round portion. The addition of such a layer tends to provide additional protection to the end surface of the coil. Preferred versions of the added layer of material include:

(A) A layer of foam bonded to the lower surface of the extruded round portion. Such a layer compliments the extruded round portion by absorbing the energy of impacts, while the extruded round portion is tear, rip and gouge resistant.

(B) A layer of corrugated plastic bonded to the lower surface of the extruded round portion. Corrugated plastic provides excellent shock protection.

(C) Where a layer of corrugated plastic has been bonded to the lower surface of an extruded round portion, a lower extruded round portion may be bonded to the lower surface of the corrugated plastic, thereby sandwiching the plastic between two layers of extruded polyethylene.

(D) A layer of kraft paper backed polyethylene bonded to the lower surface of the round portion. The kraft paper provides additional protection, and compliments the round portion by increasing rigidity and strength.

It is therefore a primary advantage of the present invention to provide a novel coil cap having a heavier-weight round portion welded to a lighter-weight skirt portion, particularly where the use of hot glue is not possible with such plastic material. A related advantage is that while the fabrics and extruded sheet material used in the present invention cannot withstand hot glue, they are otherwise more durable that known fabrics adapted for use in coil cap construction, particularly in terms of abrasion and tearing resistance.

Another advantage of the present invention is to provide a novel coil cap having a welded region that is extremely durable, and which will not separate under normal use.

A still further advantage of the present invention is to provide a novel coil cap having a welded region that is three-dimensional in nature, and that allows some bunching, wrinkling or pleating of the upper edge of the fabric skirt portion within the welded region, while still providing a smooth, attractive and strong weld.

DRAWINGS

These and other features, aspects, and advantages of the present invention will become better understood with regard to the following description, appended claims, and accompanying drawings where:

DESCRIPTION

Figure 1:
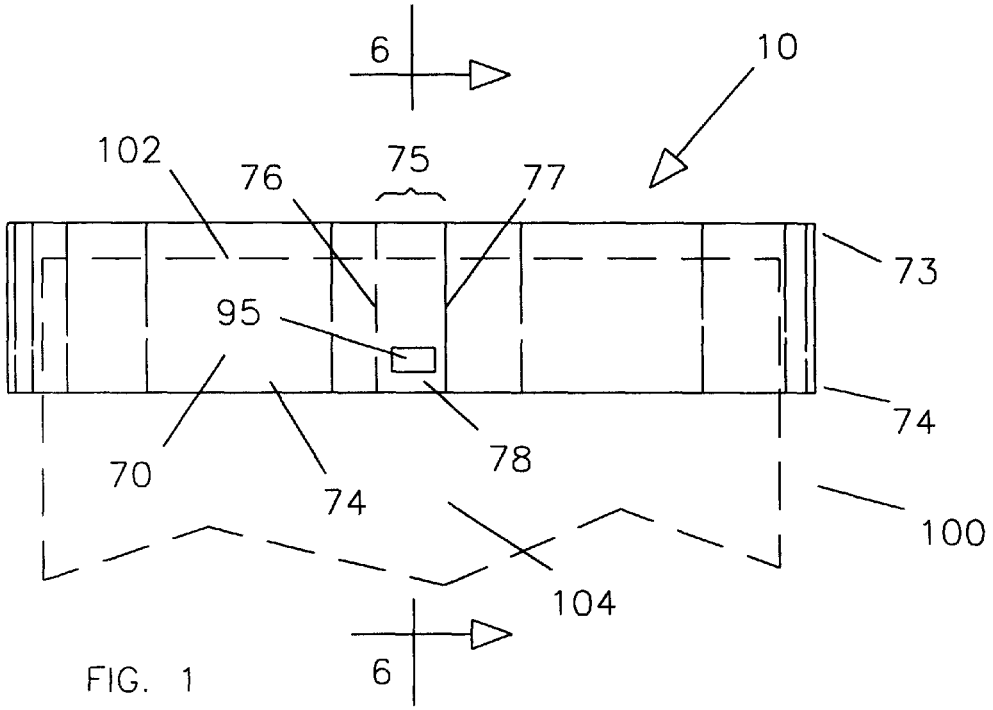
FIG. 1 is a side orthographic view of a version of the coil cap of the invention, showing an upper portion of the aluminum coil in dotted outline.

Referring generally to FIGS. 1 through 10, a coil cap 10 adapted to cover either end surface 102 and a portion of an adjacent sidewall 104 of the cylindrical body 102 of coiled aluminum is seen. The coil cap, constructed in accordance with the principles of the invention, provides a round portion 20 carrying a substantially rectangular skirt portion 70. A welded region 80 connects a perimeter edge of the round portion to an upper edge of the skirt portion, creating the three-dimensional coil cap. An overlap weld 90 fastens together the upper edges of the opposed ends of the skirt portion with a segment of the perimeter of the round portion. A crimp weld 95 fastens a lower corner of each end of the skirt portion together, creating a three dimensional coil cap that is substantially in the form of a cylinder having a single closed end.

Figure 2:
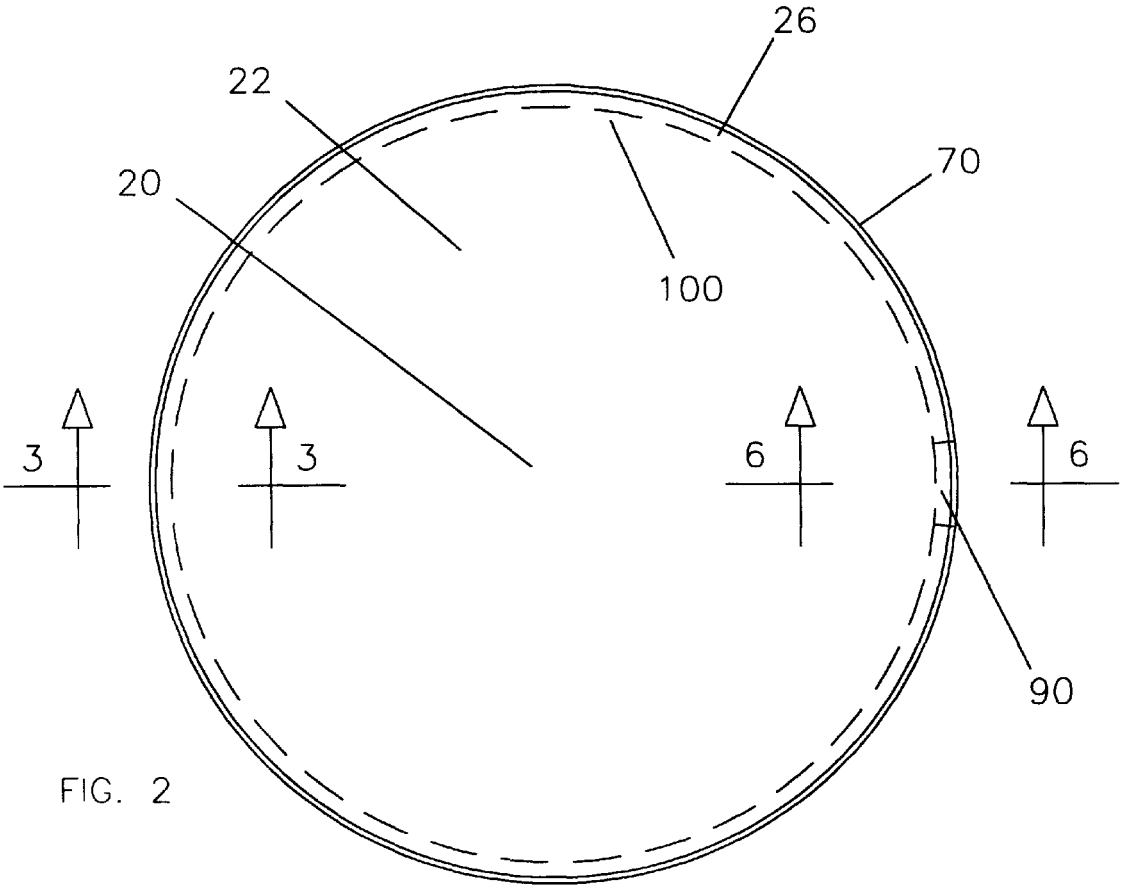
FIG. 2 is a top plan view of the coil cap of FIG. 1, also showing the aluminum coil in dotted outline.

As seen in particular in FIGS. 1 and 2, the round portion 20 protects the circular end surface 102 of a cylindrical aluminum coil 100 of rolled aluminum sheet. As seen particularly in FIGS. 3 and 6, the round portion defines upper and lower surfaces 22, 24, and a perimeter edge 26.

In a preferred embodiment of the invention, the round portion 20 is made of extruded polyethylene or other extruded plastic. The thickness of the extruded plastic may range from 0.003" to 0.5", but in a preferred embodiment ranges from 0.02" to 0.25, and is typically 0.1875".

Alternatively, the round portion 20 may be made of a woven coated polyethylene fabric having a thickness of approximately 12 mils. The fabric is typically woven from 1600 denier polyethylene tape. A coating of polyethylene having a thickness of 1.75 mils is carried on the upper and lower surfaces 22, 24. The coating of polyethylene functions primarily to allow the round fabric portion to be welded to the fabric skirt portion and to create a water-proof fabric.

The diameter of the round portion 20 is typically 10 to 90 inches, but is dependent on the size of the coiled aluminum cylinder to be covered.

Figure 3:
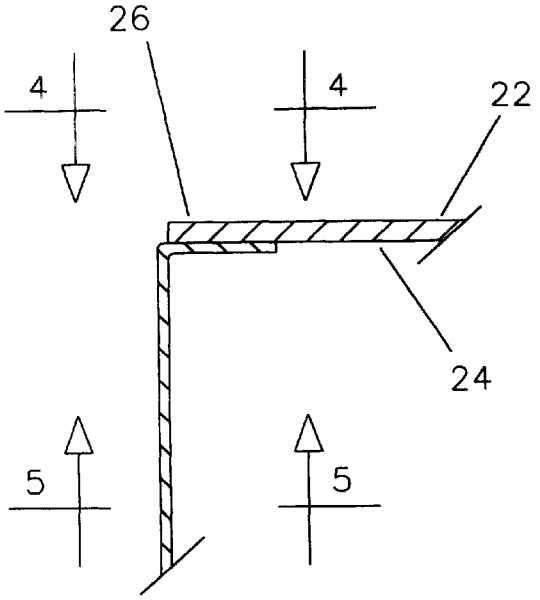
FIG. 3 is a somewhat diagrammatic cross-sectional view of the welded connection between the round portion and the skirt portion of the coil cap of FIG. 2, taken along the 3—3 lines.
Figure 6:
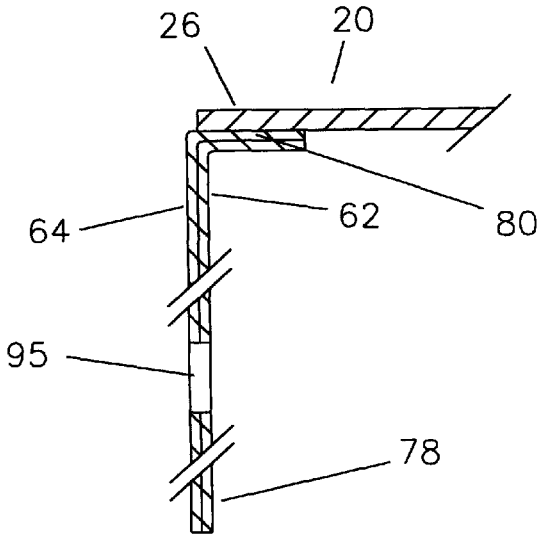
FIG. 6 is a somewhat diagrammatic view of the overlap weld connection between the round fabric portion and the upper edge of the first and second ends of the fabric skirt portion of the coil cap of FIGS. 1 and 2, taken along the 6—6 lines.
Figure 7:
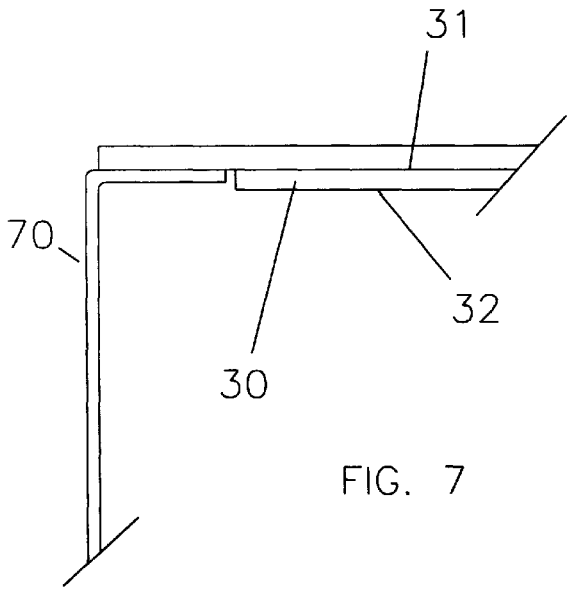
FIG. 7 is a somewhat diagrammatic cross-sectional view of a version of the round portion carrying a layer of foam on a lower surface.

In a variation of the round portion 20 of FIGS. 3 and 6, a foam backing 30 having an upper surface 31 and lower surface 32 may be applied to the lower surface 24 of the round portion, as seen in FIG. 7. The foam backing tends to provide added protection to the end surface 102 of the aluminum coil 100. The compressibility and resilience of the foam, and the tear, puncture and abrasion resistance of the round portion tend to compliment each other, resulting in greater protection.

Figure 8:
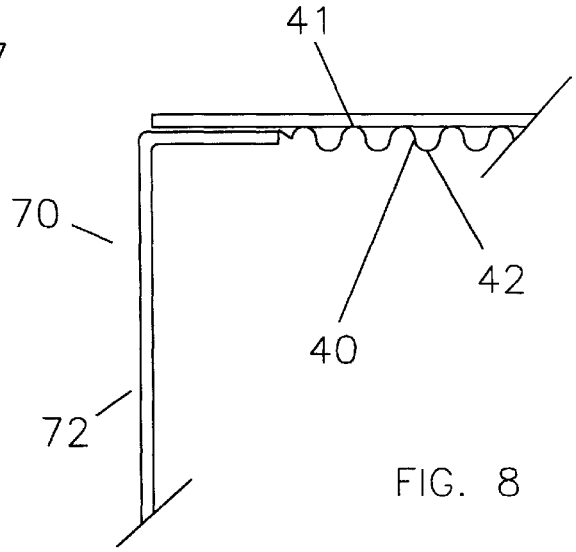
FIG. 8 is a somewhat diagrammatic cross-sectional view of a version of the round portion carrying a layer of corrugated plastic on a lower surface.

In a further variation of the round portion 20 of FIGS. 3 and 6, a corrugated plastic layer 40 may be carried by the lower surface 24 of the round portion, as seen in FIG. 8. The corrugated plastic layer is both rigid and impact-absorbing, and also tends to compliment the qualities of the round portion, thereby providing better protection for the coil 100.

Referring to FIG. 8, the corrugated plastic layer 40 is attached by an upper surface 41 to the lower surface 24 of the round portion 20. A preferred method of attachment is by welding; glue or other adhesives tend to result in recycling difficulties.

Figure 9:
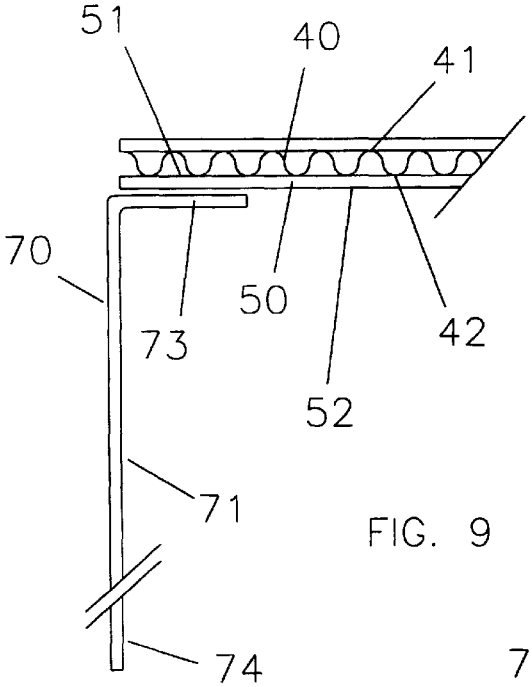
FIG. 9 is a somewhat diagrammatic cross-sectional view of a version of the round portion carrying a layer of corrugated plastic and a lower round portion.

Referring to FIG. 9, a lower round portion 50 may have an upper surface 51 attached to the lower surface 42 of the corrugated plastic layer. A preferred lower round portion is made of extruded plastic. A lower surface 52 of the lower round portion may be attached to the skirt portion 70 by welding.

The combination of upper and lower round portions 20, 50 separated by a corrugated layer 40 provides extra protection for the end surface 102 of the cylinder 100.

Figure 10:
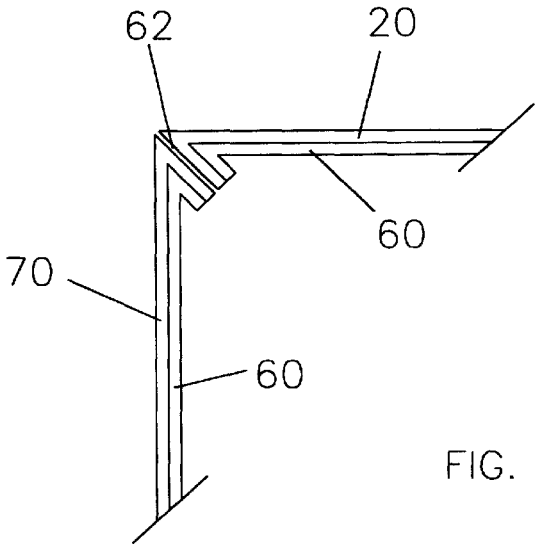
FIG. 10 is a somewhat diagrammatic cross-sectional view of a version of the coil cap wherein the round portion and skirt portion both carry a layer of kraft material on an inside surface.

Referring to FIG. 10, a kraft paper back 60, or other similar paper backing, may be adhered to the lower surface 24 of the round portion 20 or the inner surface 71 of the skirt portion 70. When applied, the kraft paper back tends to support, protect and strengthen the round portion and skirt portion.

Where a kraft paper back is used, as seen in FIG. 10, the upper surface 22 of the round portion 20 is welded to the outer surface 72 of the skirt portion, in a welded region 62.

As seen particularly in FIG. 1, the skirt portion 70 protects a portion of the sidewall 104 of the aluminum coil 100 adjacent to the end surface 102, and also functions to hold the round portion 20 in place over the end surface.

In a preferred embodiment, the fabric skirt portion 70 is made of a woven coated polyethylene having a thickness of approximately 6 mils. The fabric is woven from polyethylene tape, and carries a coating of polyethylene having a thickness of approximately 1 mil on the inner and outer surfaces 71, 72.

The height of the fabric skirt portion, from an upper edge 73 to a lower edge 74 is typically 17 inches, but may be a greater or lesser length. The length of the fabric skirt portion, between the first and second ends 76, 77, is preferably approximately 12 inches longer than the circumference of the round fabric portion. The extra 12 inches in length provides for a region of overlap 75, where the first and second ends 76, 77 are adjacent.

The exact thicknesses of both the fabric skirt portion and the round fabric portion may be varied somewhat to conform to the needs of a specific application. However, it frequently preferred that the round portion 20 is at least twice as thick as the fabric skirt portion 70. This ratio tends to afford greater protection to the end surface 102, while at the same time reducing the overall cost of the coil cap.

The thickness of the coating carried by the opposed sides of the round fabric portion and fabric skirt portion is not required to be the same. In some applications, and with some manufacturing procedures, a thicker coating on the surfaces 24, 72 to be welded together may be beneficial.

Figure 4:
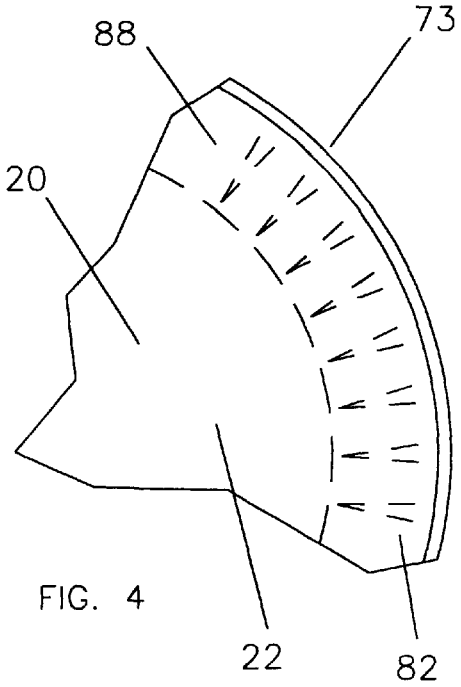
FIG. 4 is a somewhat diagrammatic top view of a portion of the welded connection between the round portion and the skirt portion of the coil cap of FIG. 3, taken along the 4—4 lines.
Figure 5:
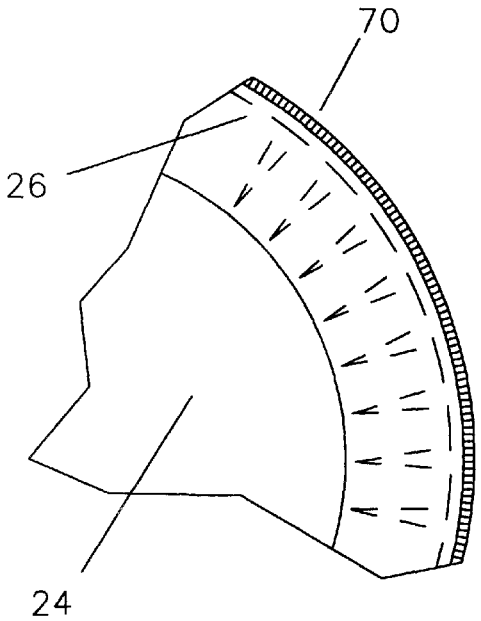
FIG. 5 is a somewhat diagrammatic bottom view of a portion of the welded connection between the round portion and the skirt portion of the coil cap of FIG. 3, taken along the 5—5 lines.

Referring particularly to FIGS. 3–5, a welded region 80 joins the upper edge 73 of the skirt portion 70 to the perimeter edge 26 of the round portion 20, thereby forming a three-dimensional coil cap. In a preferred embodiment of the invention, the welded region is approximately one inch in width.

In the manufacturing process, an approximately 1 inch strip of the outer surface 72 adjacent to the upper edge 73 of the fabric skirt portion is hot air welded to an approximately 1 inch strip of the lower surface 24 adjacent to the outer perimeter edge 26 of the round fabric portion 20, forming the welded region 80. As a result of the curvature of the perimeter edge 26, a slight wrinkle 82 is formed in the upper edge 73 of the fabric skirt, as seen in FIGS. 4 and 5. The wrinkles have no adverse effect on the quality or strength of the weld.

In a preferred method of performing the hot air welding process required to form the welded region 80, the skirt is on top and the round portion is on the bottom during the actual welding process. After the welding process is complete, the coil cap is turned right-side-out, i.e. the round fabric portion 20 is oriented on top, with the upper edge 73 of the skirt under the outer perimeter edge of the round fabric portion.

The crimp weld 95 is made in a known manner appropriate to the fabric being used for the fabric skirt.

Referring to FIGS. 2 and 6, an overlap weld 90 joins the upper edge 73 of the fabric skirt adjacent to a first end 76 of the fabric skirt 70 to the upper edge of the fabric skirt adjacent to a second end 77 of the fabric skirt and to a segment of the perimeter edge 26 of the round fabric portion 20. The overlap weld 90 therefore joins three layers of fabric. Since the length of the fabric skirt portion is preferably 12 inches longer than the circumference of the round fabric portion, the length of the overlap weld 90 is typically 12 inches.

A crimp weld 95 joins a lower corner 78 of the first end 76 of the fabric skirt 70 to a lower corner of the second end 77 of the fabric skirt. The crimp weld tends to cause the fabric skirt portion to better grip the aluminum coil 100, by more closely wrapping about the sidewall 104. As seen in FIG. 1, the crimp weld 95 is preferably closer to the lower edge 74 than the upper edge 73, although the exact location is somewhat variable.

The previously described versions of the present invention have many advantages, including a primary advantage of providing a novel coil cap having a heavier-weight round fabric portion welded to a lighter-weight fabric skirt portion, particularly where the use of hot glue is not possible with such fabrics. A related advantage is that while the fabrics and extruded sheet material used in the present invention cannot withstand hot glue, they are otherwise more durable that known fabrics adapted for use in coil cap construction, particularly in terms of abrasion and tearing resistance.

Another advantage of the present invention is to provide a novel coil cap having a welded region that is extremely durable, and which will not separate.

A still further advantage of the present invention is to provide a novel coil cap having a welded region that is three-dimensional in nature, and that allows some bunching, wrinkling or pleating of the upper edge of the fabric skirt portion within the welded region, while still providing a smooth, attractive and strong weld.

Although the present invention has been described in considerable detail and with reference to certain preferred versions, other versions are possible. For example, while specific extruded sheet and fabric materials, dimensions and thicknesses, and fabric coating thicknesses have been disclosed, as required for the preferred embodiment, it is clear that some alteration of these dimensions could be made while still in keeping with the spirit and scope of the invention. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A coil cap, adapted to cover an end surface and an adjacent portion of a sidewall of a cylindrical body, comprising:

(A) an extruded round portion;

(B) a fabric skirt portion; and (C) a welded region joining an upper edge of the fabric skirt portion to a perimeter edge of the extruded round portion, thereby forming a three-dimensional coil cap.

2. The coil cap of claim 1, wherein the thickness of the skirt portion is less than one-half the thickness of the extruded round portion.

3. The coil cap of claim 1, wherein the thickness of the skirt portion is less than 0.05 inches.

4. The coil cap of claim 1, additionally comprising an overlap weld joining the upper edge of the skirt adjacent to a first end of the skirt to the upper edge of the skirt adjacent to a second end of the skirt to a segment of the perimeter edge of the extruded round portion.

5. The coil cap of claim 1, additionally comprising a layer of foam bonded to a lower surface of the extruded round portion.

6. The coil cap of claim 1, additionally comprising a layer of corrugated plastic bonded to a lower surface of the extruded round portion.

7. The coil cap of claim 6, additionally comprising a lower round portion bonded to a lower surface of the corrugated plastic, thereby sandwiching the layer of corrugated plastic between the extruded round portion and the lower round portion.

8. The coil cap of claim 1, additionally comprising a layer of kraft paper back bonded to the lower surface of the extruded round portion.

* * * * *